United States Patent [19]

Takahashi et al.

[11] Patent Number: 4,563,076

[45] Date of Patent: Jan. 7, 1986

[54] IMAGING APPARATUS

[75] Inventors: Sadao Takahashi; Yukihiro Ohno, both of Tokyo, Japan

[73] Assignee: Ricoh Company, Ltd., Japan

[21] Appl. No.: 635,260

[22] Filed: Jul. 27, 1984

[30] Foreign Application Priority Data

Jul. 28, 1983 [JP] Japan ..... 58-117811

[51] Int. Cl.[4] ..... G03G 15/00

[52] U.S. Cl. ..... 355/3 CH; 355/3 R; 361/229; 250/325

[58] Field of Search ..... 355/3 DR, 3 BZ, 3 R, 355/3 CH, 14 CH; 361/212, 213, 225, 259; 430/902; 55/74, 387; 250/324, 325, 326

[56] References Cited

U.S. PATENT DOCUMENTS 4,470,689 9/1984 Nomura et al. ..... 355/3 R
4,500,195 2/1985 Hosono ..... 355/3 DR

FOREIGN PATENT DOCUMENTS 2827010 12/1978 Fed. Rep. of Germany ... 355/3 CH
0068638 6/1979 Japan ..... 355/3 CH
0189176 11/1982 Japan ..... 355/3 R
0136056 8/1983 Japan ..... 355/3 R
0152262 9/1983 Japan ..... 355/3 R

*Primary Examiner*—R. L. Moses
*Assistant Examiner*—David Warren
*Attorney, Agent, or Firm*—Guy W. Shoup

[57] ABSTRACT

An electrophotographic copying machine includes a main housing and an internal frame which can be detachably mounted in position defined in the main housing. The internal frame supports a photosensitive member in the form of an endless belt and a grid electrode. The main housing is provided with a corona discharger comprised of a corona wire and a casing partly surrounding the corona wire to define an opening through which corona ions are emitted. When the internal frame is mounted in position in the main housing, the grid electrode comes to be located opposite to the opening thereby functioning as a part of the corona discharger. Thus, when the internal frame is dismounted, the opening of corona discharger is exposed thereby allowing easy access to the corona wire.

8 Claims, 7 Drawing Figures

IMAGING APPARATUS

BACKGROUND OF THE INVENTION

1. Field of the Invention

This invention generally relates to an imaging apparatus and particularly to an electrostatic imaging apparatus for forming an image on a photosensitive member according to an electrophotographic image forming process.

2. Description of the Prior Art

A transfer type electrophotographic copying apparatus is well known in the art. In such an apparatus, use is made of a photosensitive member which is first uniformly charged to a predetermined polarity by means of a corona discharger and then exposed to a light image thereby causing the uniform charge to be dissipated selectively thereby forming an electrostatic latent image, followed by the steps of developing the latent image to convert the latent image into a visible toner image and transferring the toner image to a transfer medium, such as plain paper. In a repetitive process as in a commercial apparatus, the photosensitive member is typically cleaned prior to the next sequence of operation. FIG. 1 shows a typical prior art corona discharger 1 for use in charging the surface of a photosensitive member 3 uniformly. The prior art corona discharger 1 is normally provided with grid electrodes 2 in an integrated structure and provided as detachably mounted in position close to the photosensitive member 3.

As described above, there remains residual toner on the photosensitive member 3 after transfer. Thus, there is normally provided a cleaning device for cleaning the photosensitive member 3 after transfer. Even so, a slight amount of toner may still remain on the photosensitive member 3 and it may be attracted to the grid electrodes 2 located close to the photosensitive member 3 so that the grid electrodes 2 become contaminated. Furthermore, some of such residual toner may also be attracted to a corona wire 1*a* passing through the grid electrodes 2, and when the corona wire 1*a* becomes contaminated due to such deposition of toner, its discharging characteristic could be severely impaired.

Thus, it is often required to clean the corona wire 1*a*. However, with the prior art structure as shown in FIG. 1, since the grid electrodes 2 are integrally formed with the corona discharger 1 thereby having the corona wire 1*a* enclosed, it is difficult to clean the corona wire 1*a*. Moreover, after using for a substantial period of time, the grid electrodes 2 also come to be required to be cleaned. However, since the grid electrodes are typically comprised of a plurality of wire elements having the diameter in the order of 0.1–0.2 mm and arranged in a relatively complicated pattern, cleaning of such grid electrodes is rather difficult and time consuming.

SUMMARY OF THE INVENTION

It is therefore a primary object of the present invention to provide an imaging apparatus free of the above-described disadvantages of the prior art.

Another object of the present invention is to provide an imaging apparatus which is so structured to permit to carry out cleaning of corona wire with ease.

A further object Of the present invention is to provide an imaging apparatus which allows to keep its corona wire and grid electrodes free of contamination.

A still further object of the present invention is to provide an imaging apparatus in which corona wire and grid electrodes are separately provided.

Other objects, advantages and novel features of the present invention will become apparent from the following detailed description of the invention when considered in conjunction with the accompanying drawings.

DESCRIPTION OF THE PREFERRED EMBODIMENTS

Figure 1:
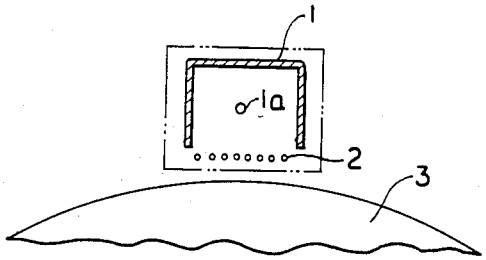
Fig. 1 Prior Art
FIG. 1 is a schematic illustration showing a typical prior art corona discharger mounted in position for use in electrophotography.
Figure 2:
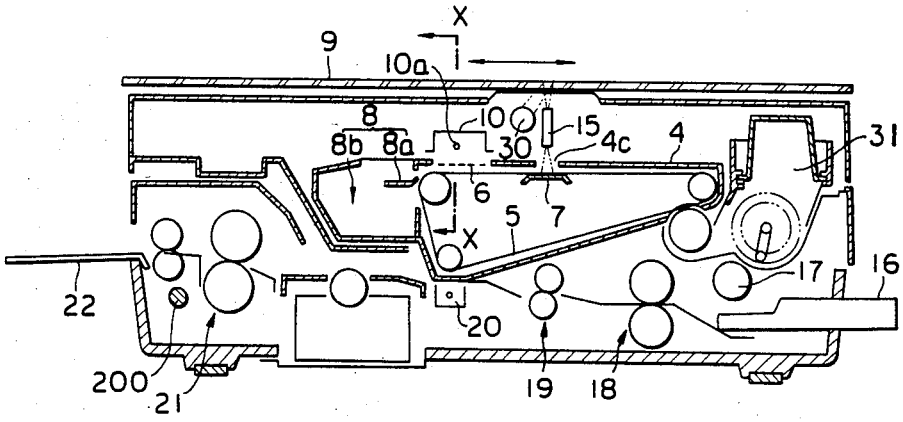
FIG. 2 is a longitudinal, cross sectional view showing the electrophotographic copying machine constructed in accordance with one embodiment of the present invention.

Referring now to FIG. 2, there is shown an electrophotographic copying machine constructed in accordance with one embodiment of the present invention. As shown, there is provided an internal frame 4 inside of and located centrally of a machine main housing 11. It is to be noted that the internal frame 4 is detachably mounted in position. Described more in detail with reference to FIG. 3, channel-shaped guide rails 11*a* and 11*b* are fixedly mounted on the main housing 11, more particularly on its front and rear walls, and the internal frame 4 is integrally provided with engaging members 4*a* and 4*b*, one on each of the front and rear sides of the internal frame 4, which are slidably engaged with the corresponding guide rails 11*a* and 11*b*. The internal frame 4 supports a photosensitive member 5 in the form of an endless belt, a grid electrode 6, an exposure station guide plate 7 and a cleaning device 8.

The internal frame 4 is also provided with a plurality of rotatable rollers and the photosensitive belt 5 is provided as extended around the rollers so that the belt 5 can travel in a predetermined direction at constant speed with one of the rollers being coupled to an exterior driving source when the internal frame 4 is mounted in position. The exposure station guide plate 7 guides the belt 5 from its inner side to have the belt 5 located in desired position during exposure. The cleaning device 8 includes a cleaner blade 8*a* having its one end in scrubbing contact with the imaging surface of the belt 5 and a tank 8*b* for collecting the toner removed from the belt 5. The grid electrode 6 is also integrally provided in the internal frame 4 at a position such that it is located close to but separated away over a predetermined distance from the belt 5 and it becomes positioned opposite to a corona discharger 10 fixedly mounted on the main housing 11 when the internal frame 4 is detachably mounted in position inside of the main housing 11 as shown in FIG. 2.

Figure 3:
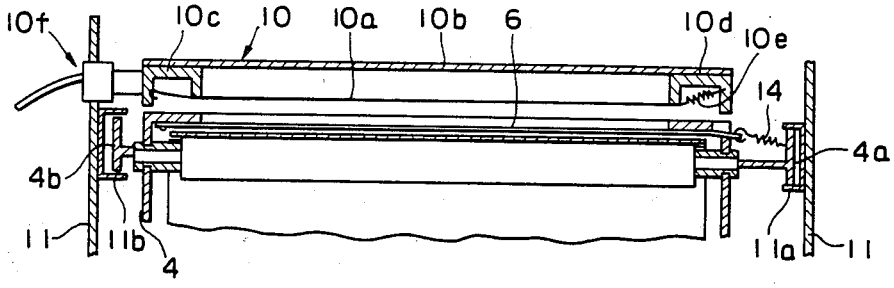
FIG. 3 is a cross sectional view taken along line X—X in FIG. 2.
Figure 4:
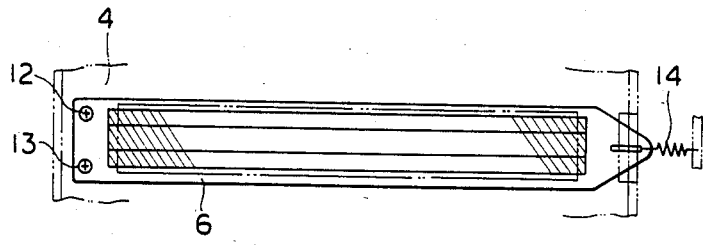
FIG. 4 is a schematic illustration showing one embodiment of grid electrode applicable to the copying machine of FIG. 2.
Figure 5:
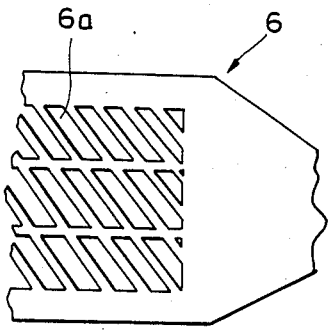
FIG. 5 is an enlarged view showing part of the grid electrode shown in FIG. 4.
Figure 6:
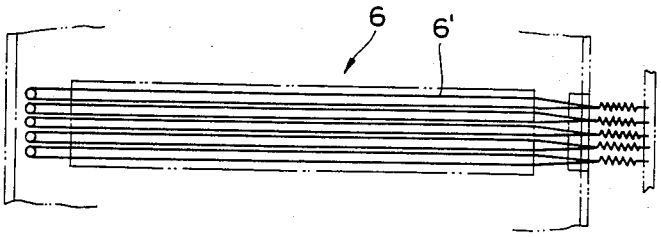
FIG. 6 is a schematic illustration showing another embodiment of grid electrode applicable to the copying machine of FIG. 2.

As shown in FIG. 3, the corona discharger 10 is integrally mounted on the main housing 11 and it includes such elements as a corona wire 10*a*, a casing 10*b* which partly encloses the corona wire 10*a*, a pair of end blocks 10*c* and 10*d* of electrically insulating material which are fixedly attached on both ends of the casing 10 for holding both ends of the corona wire 10*a*, a spring 10*e* connected between one end of the corona wire 10*a* and the end block 10*d* and a connector 10*f* mounted on the end block 10*c* for connection with a high voltage source through a cable. On the other hand, as shown in FIG. 4, the grid electrode 6 is provided with its one end fixedly attached to the internal frame 4, for example, by means of screws 12 and 13 and the other end connected to the internal frame through a spring 14. The grid electrode 6 illustrated in FIGS. 4 and 5 is comprised of a strip of metal plate elongated and generally rectangular in shape and the metal plate electrode 6 is formed with a number of inclined, slot-shaped openings arranged in three rows as best shown in FIG. 5. Alternatively, the metal plate electrode 6 may be mesh-shaped by providing a number of openings, square or rectangular. The grid electrode 6 shown in FIG. 6 is comprised of a plurality of wire elements 6' which are arranged in parallel.

Figure 7:
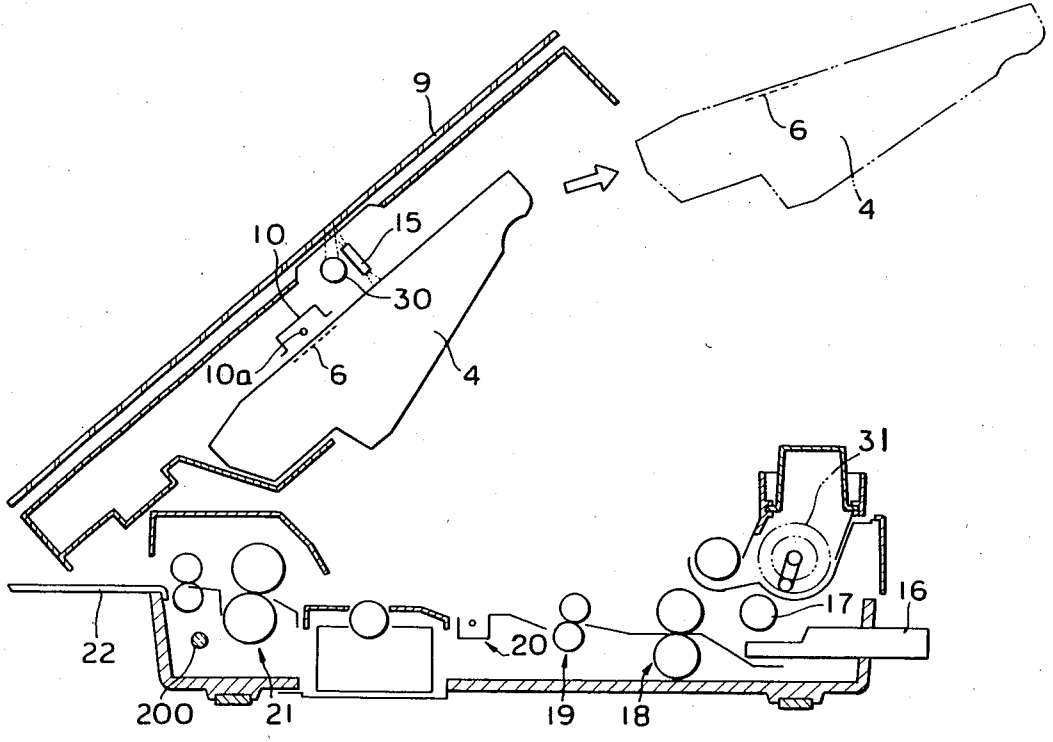
FIG. 7 is a schematic illustration showing the condition in which the top half of the copying machine is pivotted open thereby allowing an internal frame to be detached from the top half.

With the above-described structure, simply by having the internal frame 4 mounted in position in the main housing 11 through the engagement between the engaging members 4*a*, 4*b* and the guide rails 11*a*, 11*b*, the grid electrode 6 is located at the opening of the corona discharger 10, which is fixedly mounted on the main housing 11, thereby allowing to serve as a functional element of the corona discharger 10 in charging the photosensitive belt 5 uniformly. It is to be noted that the present copying machine is structurally divided into two parts, i.e., top and bottom halves, and the bottom half is stationarily provided with the top half pivotally supported at a shaft 200. Thus, as shown in FIG. 7, the top half can be pivotted counterclockwise around the shaft 200 thereby exposing the interior of the copying machine. With the top half being pivotted open as shown in FIG. 7, the internal frame 4 may be pulled out of the top half as indicated by the arrow so that the corona wire 10*a* becomes readily accessible through the opening of corona discharger 10 since the grid electrode 6 is integrally provided with the internal frame 4 and thus it is also moved away from the corona discharger 10 when the internal frame 4 is detached. It will thus be understood that the corona wire 10*a* can be cleaned with ease under the condition.

It should also be noted that the photosensitive belt 5 also needs to be replaced from various reasons including aging. In such a case, the internal frame 4 may be replaced with a new one in its entirety. This also indicates that the grid electrode 6 is also replaced with a new one since it is integrally provided with the internal frame 4. As described previously, contamination of grid electrode 6, e.g., due to deposition of toner, does not affect the corona discharging characteristics as much as contamination of corona wire 10*a* does. However, the grid electrode 6 can also deteriorate the corona discharging characteristics when contaminated, it is preferred that the grind electrode 6 be also replaced with a new one after having been used for a period of time. In accordance with the present invention, since the grid electrode 6 is provided integrally with the internal frame 4 and separately from the corona discharger 10 though it serves as a functional element of the corona discharger 10 when the internal frame 4 is mounted in position, replacement of the grid electrode 6 with a new one is automatically carried out when the internal frame 4 is replaced with a new one, which is quite advantageous.

The corona discharger 10, mainly composed of corona wire 10*a* and its casing which partly encloses the corona wire 10*a* to define the opening through which corona ions are emitted to the belt 5, is fixedly mounted on the main housing 11, as described above. This is partly because the distance between the photosensitive belt 5 and corona wire 10*a* is not so critical as compared with the distance between the grid electrode 6 and the photosensitive belt 5 and thus it is not necessary to provide the corona wire 10*a* in the internal frame 4 to secure the distance between the corona wire 10*a* and the belt 5. Moreover, the corona wire 10*a* is contaminated not as much as the grid wire 6, in part, because of the longer distance to the photosensitive belt 5. The corona wire 10*a* is relatively expensive as compared with the grid electrode 6 so that it is not economical to structure that the corona wire 10*a* is also replaced with a new one at the time of replacement of internal frame 4.

As shown in FIGS. 2 and 7, the copying machine is also provided with a transparent original holder 9 for holding thereon an original to be copied, which is comprised, for example, of a glass plate and which moves back and forth in a reciprocating manner as indicated by the arrow in FIG. 2 for scanning. The copying machine is also provided with a focusing device 15 comprised of an array of image forming elements having short focal length and a light source 30 disposed in the vicinity of the focusing device 15, so that light emitted from the light source 30 illuminates the original placed on the original holder 9 and the light reflecting from the original on the holder 9 impinges on the belt 5 through an exposure slot 4*c* formed in the internal frame 4. In this manner, slit scanning of the original on the holder 9 is carried out.

The illustrated copying machine is also provided with a paper cassette 16 containing therein a stack of cut sheets of paper which are fed one by one from the top of the stack by means of a feed roller 17 into a paper travelling path defined through the copying machine. Along the paper travelling path, a transport roller 18 is disposed downstream of the feed roller 17 and a registration roller 19 is disposed downstream of the transport roller 18. An image transfer corona unit 20 is also provided in the copying machine as disposed downstream of the registration roller 19 and close to a portion of the photosensitive belt 5. Thus, the cut sheet of paper transported by the rollers 17, 18 and 19 in association with the advancement of the imaging belt 5 receives a toner image as transferred from the belt 5 while it moves past the image transfer corona unit 20. The copying machine is also provided with a developing unit 31 by which an electrostatic latent image formed on the belt 5 is developed thereby converting the latent image into toner image. An image fixing unit 21 is also provided in the copying machine, which causes the toner image transferred to a cut sheet of paper to be fixed thereto and which transports the thus image-fixed cut sheet of paper onto a tray 22.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. An imaging apparatus comprising:

a main housing;

a corona discharger mounted on said housing, said corona disacharger including a corona emitting means and a casing partly surrounding said corona emitting means and defining an opening;

an internal frame which is detachably mounted in position in said housing, said internal frame supporting an image bearing means and a grid electrode which is located opposite to said opening when said internal frame is mounted in position, thereby allowing said corona discharger to cooperate with said grid electrode for uniformly charging said image bearing means;

means mounted on said housing for forming an electrostatic latent image on said image bearing means by having the uniform charge dissipated selectively according to image information; and developing means mounted on said housing for developing said latent image on said image bearing means thereby converting said latent image into a toner image.

2. The apparatus of claim 1 further comprising an image transfer unit mounted on said housing for transferring said toner image onto a transfer medium which is transported along a predetermined path defined in said housing.

3. The apparatus of claim 2 wherein said internal frame further supports cleaning means for cleaning said image bearing means after image transfer.

4. The apparatus of claim 2 wherein said housing is provided with a pair of guide rails and said internal frame is provided with a pair of engaging members which are slidably engageable with said pair of guide rails so that said internal frame may be set in position through engagement between said pair of guide rails and said pair of engaging members.

5. The apparatus of claim 4 wherein said housing is generally divided into top and bottom halves which are pivotally connected at one end thereby allowing said top half to be pivotally moved with respect to said bottom half to have an interior of said apparatus exposed along a dividing line between said top and bottom halves.

6. The apparatus of claim 5 wherein said pair of guide rails are fixedly mounted on said top half thereby allowing said internal frame to be detachably mounted in position within a space defined in said top half.

7. The apparatus of claim 1 wherein said image bearing means includes an photosensitive member in the form of an endless belt which is extended around a plurality of rollers rotatably supported by said internal frame.

8. The apparatus of claim 7 wherein said means for forming includes an exposure means for exposing said photosensitive member to light having image information.

* * * * *